US005680652A

United States Patent [19]

Paine

[11] Patent Number: 5,680,652

[45] Date of Patent: Oct. 28, 1997

[54] WEDDING DRESS DESIGN KIT

[76] Inventor: Janie A. Paine, 212 Dawson Ave., Rockford, Ill. 61104

[21] Appl. No.: 717,932

[22] Filed: Sep. 23, 1996

[51] Int. Cl.[6] ..... A41D 1/22

[52] U.S. Cl. ..... 2/105; 2/74; 2/119; 2/126; 2/211

[58] Field of Search ..... 2/105, 74, 75, 2/118, 119, 126, 210, 216, 211, 271, 912–914, 919

[56] References Cited

U.S. PATENT DOCUMENTS

| | | | |
|---|---|---|---|
| 2,690,564 | 10/1954 | Kingston et al. | 2/105 |
| 3,064,265 | 11/1962 | Bridgewaters | 2/105 |
| 4,658,443 | 4/1987 | Beman | 2/105 |
| 4,754,500 | 7/1988 | Brucato et al. | 2/105 |
| 5,146,626 | 9/1992 | Rosado | 2/105 |
| 5,173,965 | 12/1992 | Panner | 2/105 |

FOREIGN PATENT DOCUMENTS

| | | | |
|---|---|---|---|
| 1378814 | 12/1974 | United Kingdom | 2/105 |
| 2225215 | 5/1990 | United Kingdom . | |

*Primary Examiner*—Gloria Hale
*Attorney, Agent, or Firm*—Leydig, Voit & Mayer, Ltd

[57] ABSTRACT

A wedding dress design kit which enables a wide variety of wedding dress designs to be created from a relatively small number of dress components. The present invention provides a kit which can be used by bridal shops to create customized wedding dresses without the need of maintaining an expensive inventory of single-sized wedding dresses. The present invention provides a kit comprised of a number of differently shaped bodices, a number of differently shaped sleeves, a number of differently shaped skirts, and a number of differently shaped trains. Each bodice, sleeve, skirt, and train is provided with a mechanism for adjusting the respective dimensions of each piece so that regardless of the size of the bride attempting to try the dresses on, the component parts will be able to be adjusted to fit each bride. The present invention therefore provides a wedding dress design kit which reduces the financial obligations required of bridal shops, while increasing the customization and satisfaction of the purchasing bride.

13 Claims, 6 Drawing Sheets

WEDDING DRESS DESIGN KIT

FIELD OF THE INVENTION

The present invention generally relates to apparel design, and more particularly relates to methods and devices for designing dresses.

BACKGROUND OF THE INVENTION

The process of wedding dress design and selection is generally a time-consuming, expensive, and frustrating endeavor. Brides invariably enter the process as excited and hopeful to receive the dress of their dreams, and are all too often greeted with a process which allows little room for customization, and which is so expensive and time-consuming that it saps much of the excitement from an act which should be an enjoyable process. The present invention endeavors to greatly improve this process not only for the bride, but for the bridal shop owner as well.

Typically, a bride selects a wedding dress by consulting a bridal shop wherein the bride will be able to sample dresses from a number of different designers, but which are often only available in a single size in an effort to roughly "fit" the great majority of brides entering the shop. The process therefore only allows the bride to select a dress based on the general appearance of a given design, without knowing exactly how the dress will appear once it is custom tailored for her unique measurements. Moreover, it is not until the general dress design is selected, the measurements taken, and the dress is ordered and returned from the manufacturer, that the bride realizes, often to her dismay, that expensive alterations are necessary. Since the dress manufacturer typically only returns a dress meeting the general size requirements of the order, it is incumbent upon the bridal shop owner to make the actual alterations. Given the fact that the dresses are often manufactured in an assembly line fashion, the process is further lessened in effectiveness in that there is often little room for unique alterations or additions to the dress design which thereby results in a severely limited degree of customization.

Therefore, from the perspective of the bride, it can be seen that the current process is time-consuming, expensive, frustrating, and devoid of adequate customization.

For the bridal shop owner, the process is equally unacceptable. Wedding dresses are currently available through a number of individual designers, and since each designer will usually have a number of different designs, each bridal shop will be responsible for maintaining an expansive collection of dresses which results in a financial outlay often exceeding $100,000.00. To economically lessen this load, bridal shops are often forced to carry only a few design lines, which lessens cost, but which lowers the satisfaction of the purchasing bride. Given the whimsical nature of the fashion industry, these designs can be changed in a matter of months, and the bridal shop is left with not only an expensive inventory, but also with the daunting task of finding buyers for dresses which have already been tried on by multiple parties.

Therefore, from the perspective of the bridal shop owner, it can be seen that the process as it currently exists is a financially imposing one which either precludes a great number of competitors from entering the field, or greatly limits the potential of those players already engaged in the practice.

SUMMARY OF THE INVENTION

In light of the foregoing, it is the primary objective of the present invention to provide a wedding dress design kit which greatly lessens the financial burden placed on bridal shops while greatly increasing the ability to customize a wedding dress to thereby result in a more satisfied customer.

In that regard, it is a feature of the present invention to provide a wedding dress design kit comprised of four basic parts wherein each part is available in numerous shapes and designs. By selecting one style of each basic part, the main outline of a wedding dress can be created and the need for maintaining a large inventory of differently designed dresses is eliminated.

Another feature of the present invention to accomplish the foregoing is to provide the various shapes of the four basic parts with means for adjusting the relative sizes of each so that with one kit, dresses can be created to fit a wide range of body sizes and types.

A still further feature of the present invention to accomplish the foregoing is to include a number of accessories with the wedding dress design kit which can be temporarily affixed to the basic parts to customize the wedding dress without the need of maintaining an inventory of wedding dresses with substantially the same outline but with various adornments and customizations.

Another objective of the present invention is to greatly increase the speed with which the wedding dress design process is performed by providing the bride with an immediate impression as to the ultimate appearance of the dress design.

In this regard, it is a feature of the present invention to provide a kit wherein a multitude of dress designs can be quickly created from a relatively small number of dress parts with means for adjusting the parts to fit virtually all sizes, to thereby eliminate the time-consuming process of placing an order with a factory, receiving the roughly dimensioned dress back from the factory, trying the dress on, altering the dress, and then finally having a chance to review the appearance of the resulting dress.

These and other objectives and features of the present invention will become more apparent from the following detailed description when taken in conjunction with the accompanying drawings.

Figure 1:
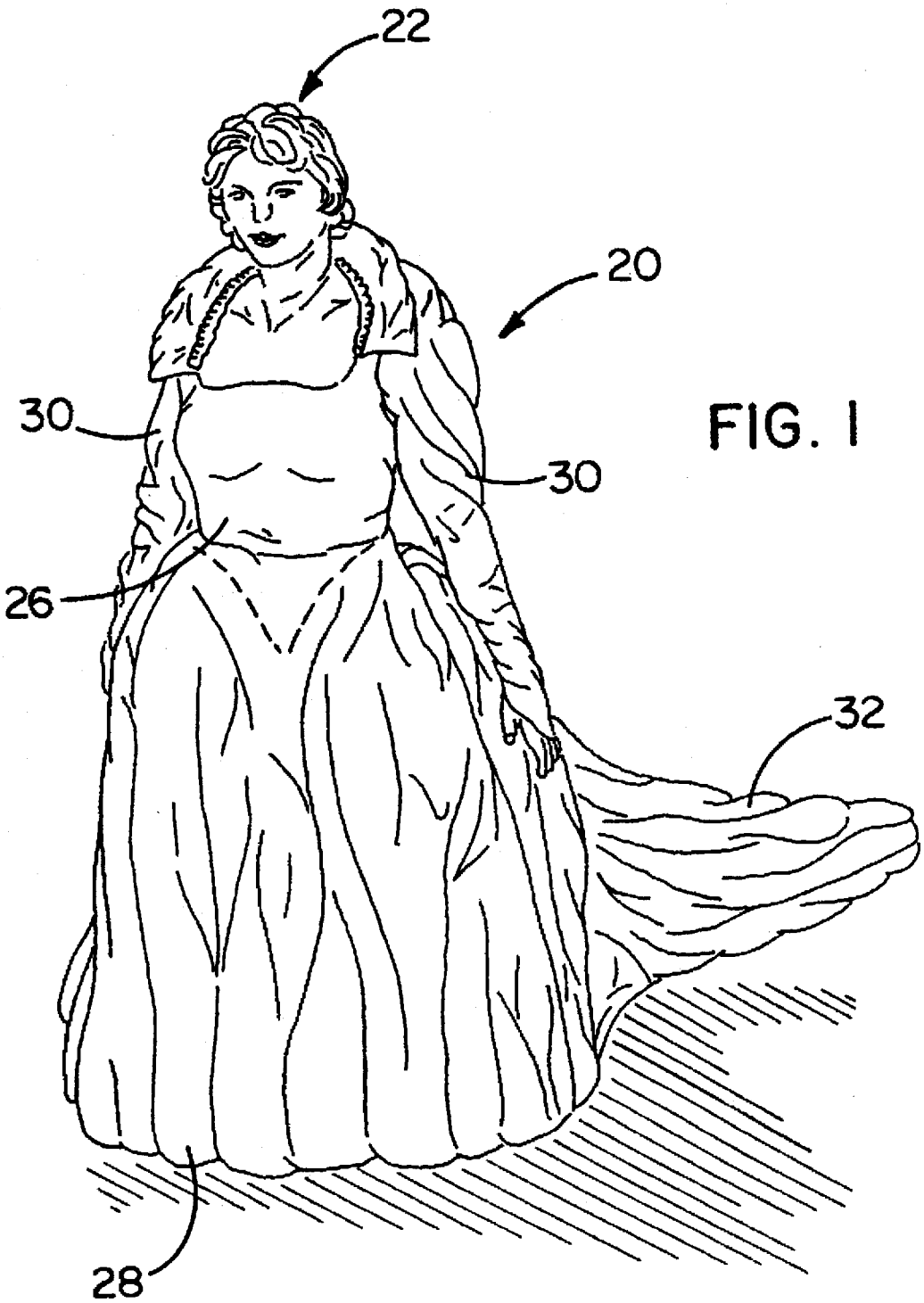
FIG. 1 is a perspective view of a completed wedding dress from the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the figures, dress 20, which can be created from the present invention is shown in perspective in FIG. 1. Dress 20 for bride 22 is created from the present invention through a kit 24 comprised of at least one design of bodice 26, at least one design of skirt 28, at least one design of sleeve 30, and at least one design of train 32. By providing bodices 26, skirts 28, sleeves 30, and trains 32 of various shapes and designs, a wide array of resulting wedding dress designs can be attained.

Although only one wedding dress 20 is shown in FIG. 1, it is to be understood that a potentially limitless number of dress designs can be created based on the number of individual component designs provided in kit 24. In the preferred embodiment, however, kit 24 consists of four different bodice 26 designs (FIGS. 3*a*–3*d*), four different sleeve 30 designs (FIGS. 4*a*–4*d*), three different skirt 28 designs (FIGS. 5*a*–5*c*), and three different train 32 designs (FIGS. 6*a*–6*c*).

Figure 2:
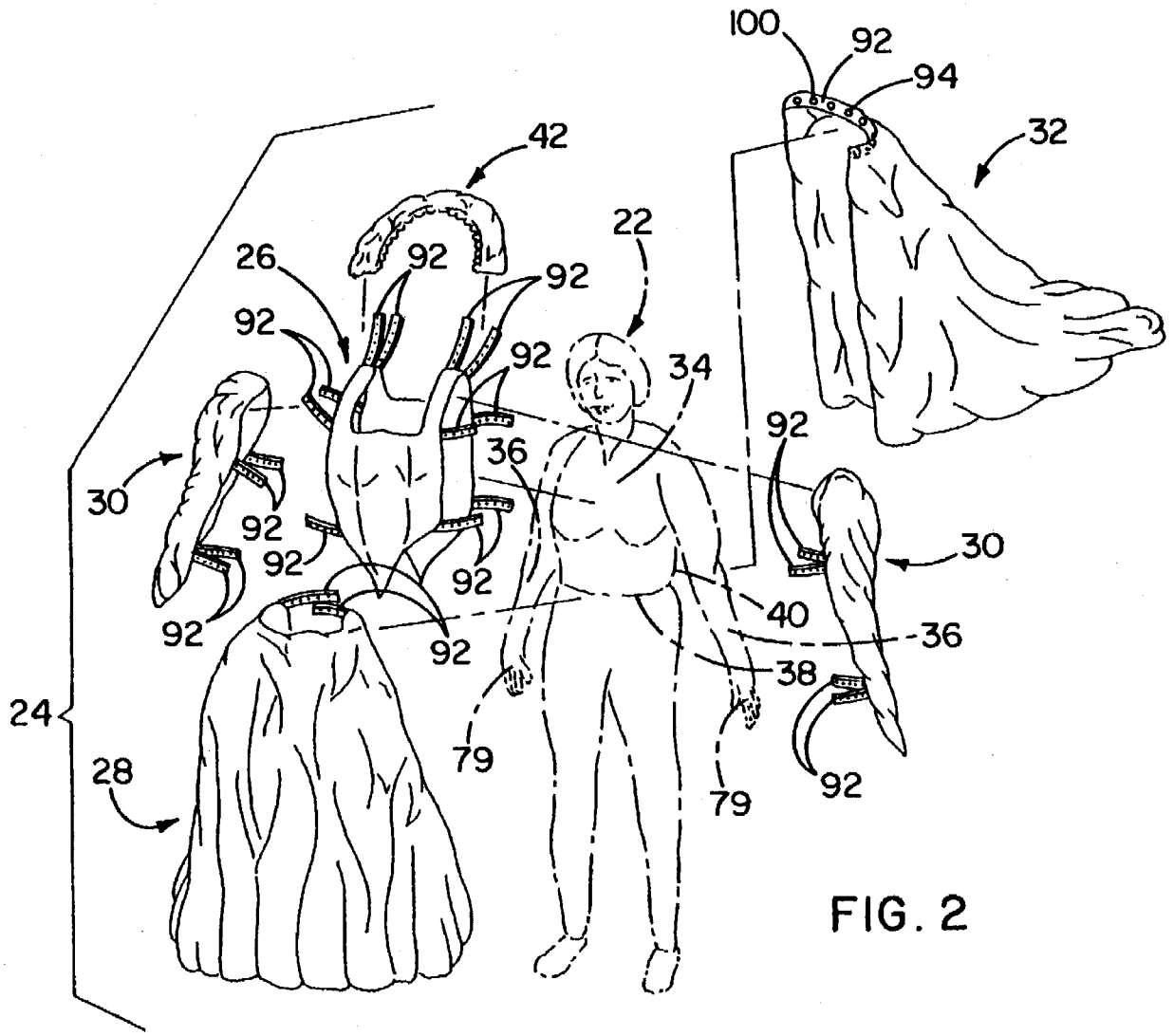
FIG. 2 is an exploded perspective view of a wedding dress showing the connections and orientation of each part of the present invention.
Figure 3A:
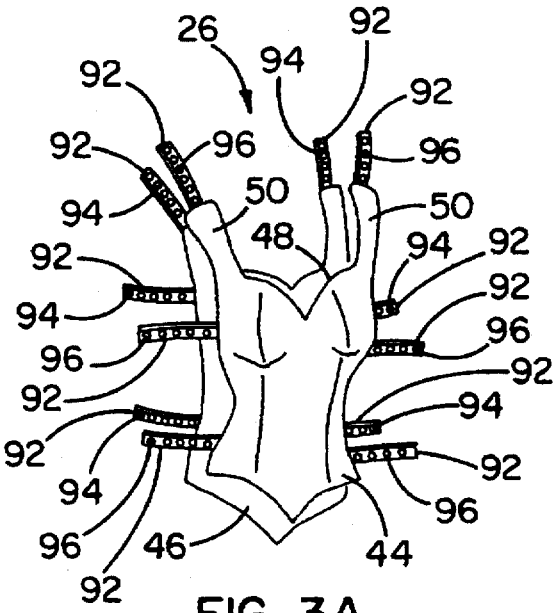
FIG. 3*a* is a perspective view of bodice A of the present invention.
Figure 3C:
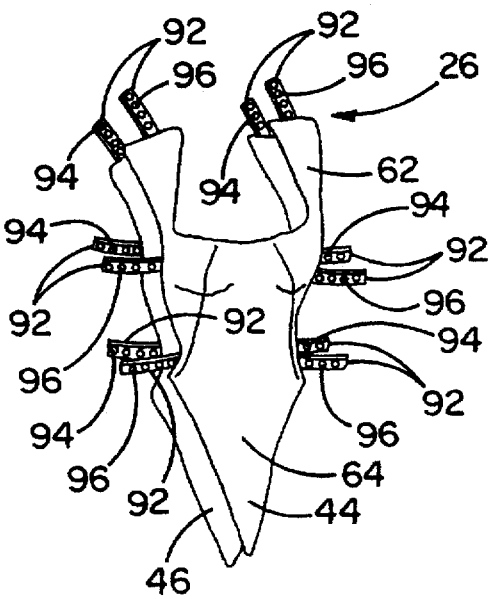
FIG. 3*c* is a perspective view of bodice C.
Figure 3B:
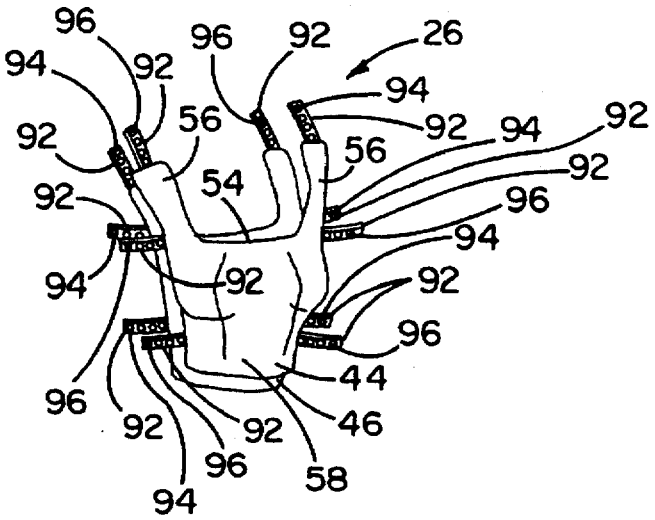
FIG. 3*b* is a perspective view of bodice B.
Figure 3D:
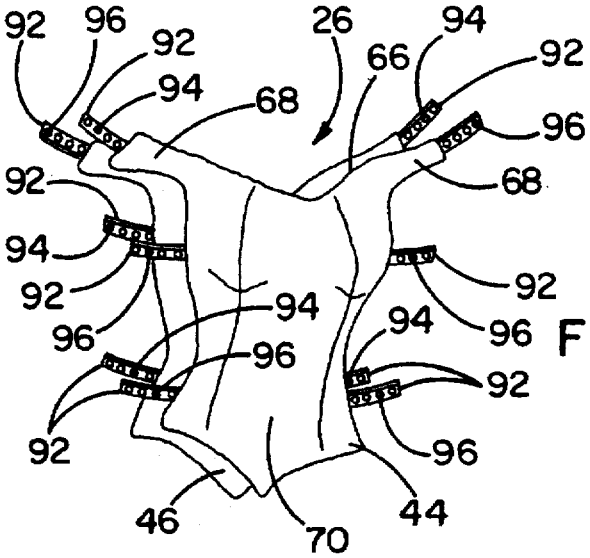
FIG. 3*d* is a perspective view of bodice D.

Referring now to FIG. 2, dress 20 is shown with bodice 26, skirt 28, sleeves 30, and train 32 exploded away from bride 22 to show how dress 20 is assembled. As shown, bodice 26 is adapted to be placed over torso 34 of bride 22, sleeves 30 are adapted to be placed over arms 36 of bride 22, skirt 28 is adapted to be placed about waist 38 of bride 22, and train 32 is adapted to be fastened about back 40 of bride 22.

Also shown in FIG. 2, once the main components of dress 20 are selected, dress 22 can be additionally modified by the addition of various accessories. Although only lace collar 42 is shown in FIG. 2, it is to be understood that once the main components of dress 20 are selected, the appearance of dress 20 can be substantially altered by the addition of such accessories as sequins, beads, bows, borders, and the like. It is also to be understood that the fabric from which bodice 26, skirt 28, sleeves 30, and train 32 are manufactured can be varied, and it is currently contemplated that such materials could include such materials as silk and satin, as well as other natural and synthetic fabrics. Swatches of various types of material are included with wedding dress design kit 20.

Turning now to the individual designs of the component parts of dress 20, four distinct bodice 26 designs are shown in FIGS. 3*a*–3*d*. Although only four bodice 26 designs are shown, this application should not be construed to only disclose the four embodiments shown in FIGS. 3*a*–3*d*. Nonetheless, it is intended that the wide majority of dress 20 designs can be manufactured from the four basic bodice 26 designs shown in FIGS. 3*a*–3*d*.

As shown, each bodice 26 is comprised of a front panel 44 and a back panel 46. Front panel 44 and back panel 46 are of substantially similar shape in bodices A, B, C, and D. Bodice A, shown in FIG. 3A, includes "sweetheart" neckline 48, upright straps 50, and "basque" waist 52, whereas bodice B, shown in FIG. 3B, includes "scoop" neckline 54, upright straps 56, and truncated waist 58. Bodice C, shown in FIG. 3C, includes "Elizabethan" neckline 60, flared straps 62, and "medieval" waist 64. Finally, bodice D, shown in FIG. 3D, includes "off-the-shoulder" neckline 66, offset straps 68, and "basque" waist 70 similar to waist 52 of bodice A.

Figure 4A:
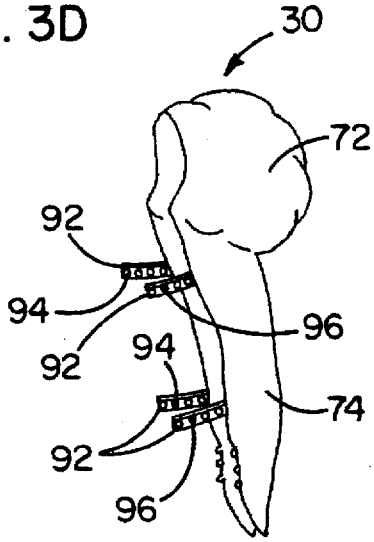
FIG. 4*a* is a perspective view of sleeve A.
Figure 4B:
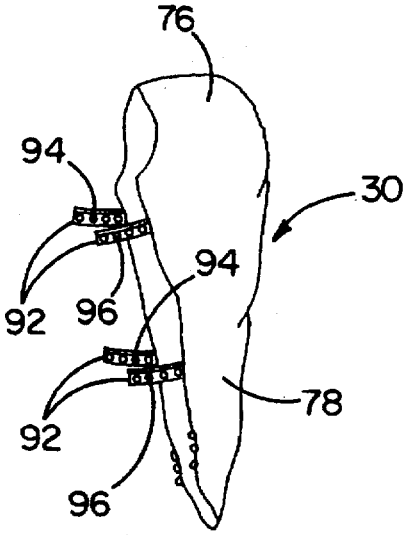
FIG. 4*b* is a perspective view of sleeve B.
Figure 4C:
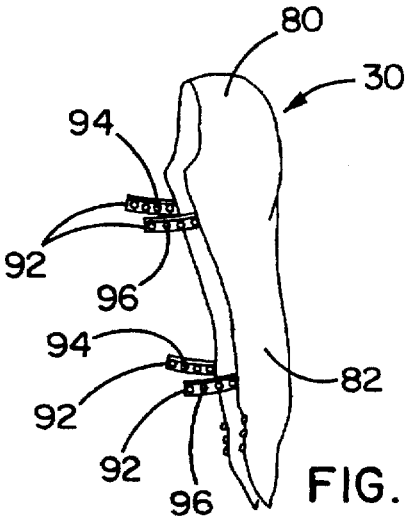
FIG. 4*c* is a perspective view of sleeve C.
Figure 4D:
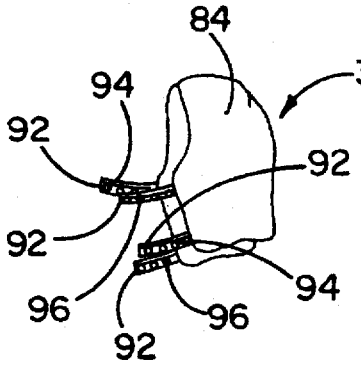
FIG. 4*d* is a perspective view of sleeve D.

Four different sleeve 30 designs are shown in FIGS. 4*a*–4*d* and are adapted to be fastened to bodices A–D adjacent the straps of each bodice. In the preferred embodiment, sleeves 30 are temporarily fastened to bodice 26 via tongue and loop fasteners such as that commercially available under the tradename, Velcro, but other mechanisms are possible. Sleeve A shown in FIG. 4A includes pillowed or "Juliette" shoulder 72, with form fitting sleeve 74 affixed thereto. Sleeve B, shown in FIG. 4B, includes padded or "Renaissance" shoulder 76 and "natural" sleeve 78 which leads from shoulder 76 to the hand 79 of bride 22. Sleeve C, shown in FIG. 4C, includes "natural" shoulder 80 as well as "natural" sleeve 82. Sleeve D, shown in FIG. 4D, is of a shortsleeved design and includes "tulip" shoulder 84.

Figure 5B:
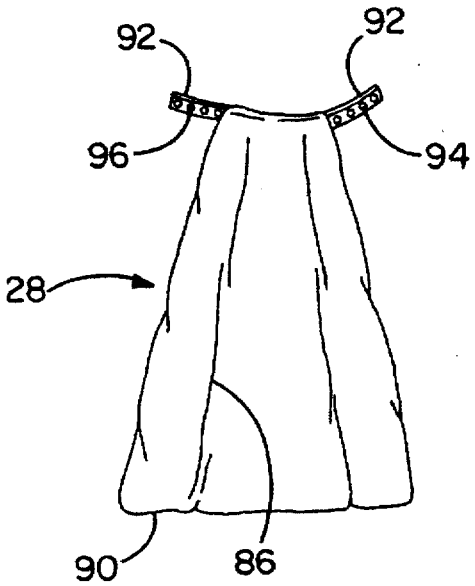
FIG. 5*b* is a perspective view of skirt B.
Figure 5A:
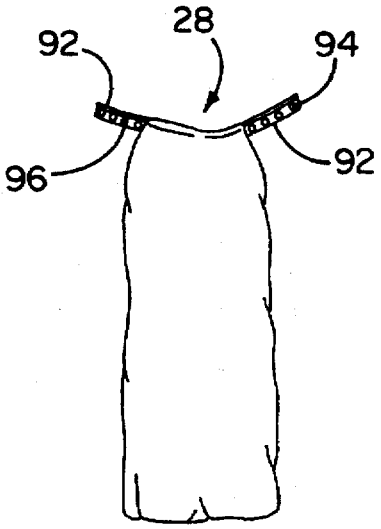
FIG. 5*a* is a perspective view of skirt A.
Figure 5C:
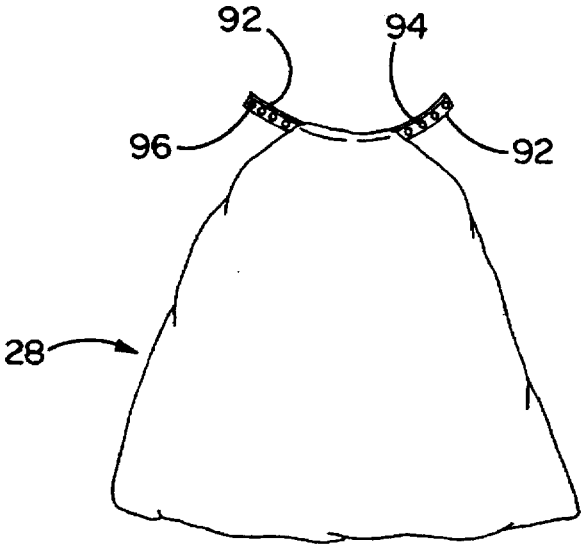
FIG. 5*c* is a perspective view of skirt C.
Figure 6A:
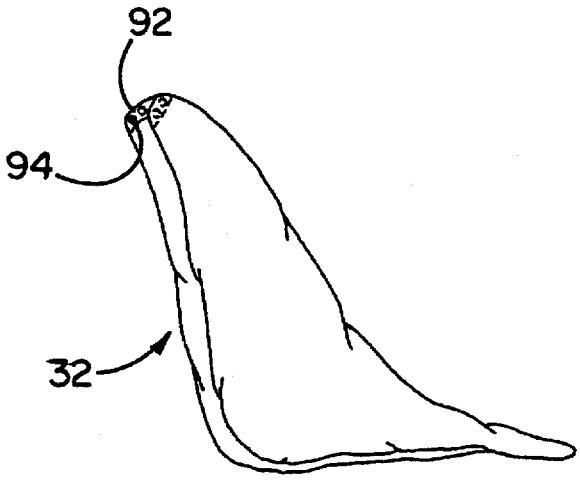
FIG. 6*a* is a perspective view of train A.
Figure 6B:
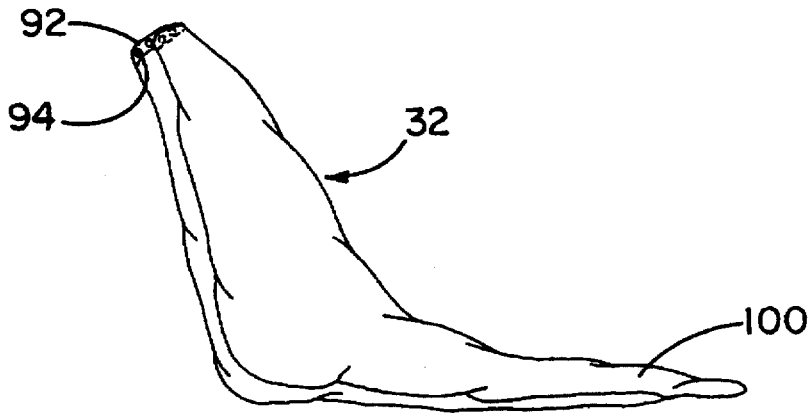
FIG. 6*b* is a perspective view of train B.
Figure 6C:
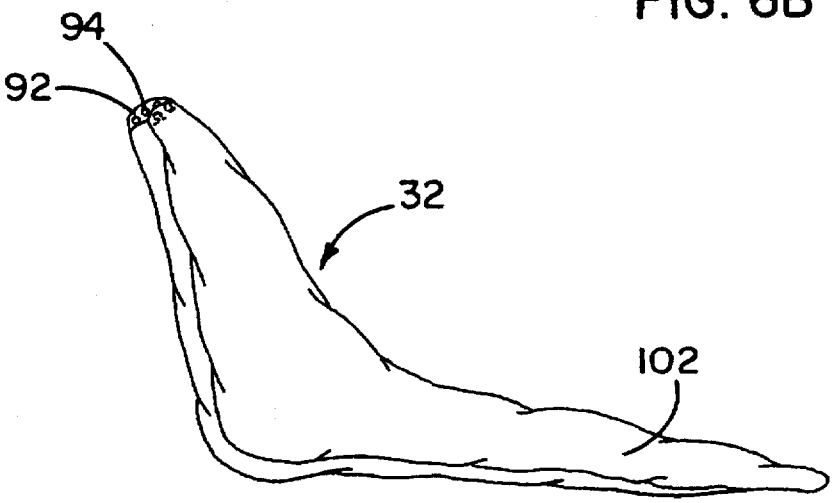
FIG. 6*c* is a perspective view of train C.

The three skirt 28 designs currently contemplated are shown in FIGS. 5*a*–5*c*, and vary from the narrow or "sheath" design of skirt A (FIG. 5A) to the fanned or "full" design of skirt C (FIG. 5C). Skirt B, shown in FIG. 5B, is an "A-line" skirt and includes a plurality of seams 86 which extend from waistband 88 to hem 90.

The three currently contemplated trains 32 of the present invention are shown in FIGS. 6*a*–6*c*. The substantial difference between trains 32 is their respective lengths. Train A, as shown in FIG. 6A, is referred to as a "chapel" train and includes three feet of fabric 98 which is carried along the ground, while train B (FIG. 6B), the "cathedral" train, includes five feet of fabric 100 which is carried along the ground. Train C, the "royal" train, includes eight feet of fabric 102 which is carried along the ground as shown in FIG. 6C. Of course, the number of feet of fabric which is carried along the ground can be substantially varied, but it is intended that trains 32 depicted in the figures will be able to satisfy the vast majority of design criterion.

As shown throughout the figures, the present invention provides pairs of mating seam tapes 92 at predetermined locations on bodices 26, skirts 28, sleeves 30, and trains 32. Seam tapes 92 can be manufactured from any suitably strong and durable fabric and are sewn or otherwise fastened to the component parts of dress 20 as shown in the figures. Each piece of seam tape 92 is provided either with a plurality of snap bottoms 94, or a plurality of snap tops 96. Snap bottoms 94 and snap tops 96 are of a conventional design wherein bottoms 94 are telescopingly received into snap tops 96 and are frictionally held therein until sufficient force is applied to remove snap tops 96 from snap bottoms 94. As shown in the figures, snap bottoms 94 and snap tops 96 are provided at regular intervals along the length of seam tape 92 with a spacing interval of one inch used in the preferred embodiment. Therefore, by adjusting the individual snap bottom 94 to which each individual snap top 96 is connected, the resulting length of seam tape 92, and accordingly the resulting size of the component parts, can be adjusted. In addition, since the snaps are provided every inch, the particular snap top to which each snap bottom is attached will indicate the measurements of the bride by adding the length of the part to the length of the fastened seam tape. To facilitate the measuring process, the seam tapes could be provided with numerical graduations wherein each snap would represent a different overall measurement. Although snap bottoms 94 and snap tops 96 are shown in the preferred embodiment, it is to be understood that other suitable means of fastening can be used such as tongue and loop fasteners, buttons, and the like.

Seam tapes 92, as described above, are used to adjust the relative girth of each part, with the exception of the tapes attached to the shoulder straps of each bodice 26 which adjust the girth and length of each bodice 26. If the length of sleeves 30 or skirts 28 are to be adjusted it is envisioned that they can be temporarily pinned up, or rolled up, to better fit bride 22. Although it is not shown, it is also possible that the lengths of skirts 28, and sleeves 30 could alternatively be adjusted by providing fasteners along hem 90 of skirt 28, and adjacent the hand end of sleeve 30. To attach trains 32, seam tape 92 is provided on top edge 100 of each train 32. Trains 32 are affixed to the back of each bodice 26 by seam tape 92 cooperating with a mating seam tape provided on the back of bodice 26.

Kit 24 also includes a supply of accessories which can be affixed as by pinning to the exterior surfaces of bodices 26, skirts 28, sleeves 30, and trains 32 once the basic configuration of dress 20 is selected. As best shown in FIGS. 1 and 2, accessories such as lace collar 42 can be used to distinctly design dress 20. A wide array of accessories can be used such as borders, beads, bows, flowers, peplums, and the like. The accessories will be provided in a container or bag (not shown) as part of kit 24. If bride 22 cannot envision how dress 20 will appear even after the parts are selected, tapes 92 are adjusted, and the accessories are pinned to dress 20, a sketch or other rendering can be created absent the snaps, tongue and loop fasteners, and pins to clearly show the resulting dress. Moreover, kit 24 includes a catalog of possible designs (not shown) which will assist bride 22 in designing her dress.

In operation, kit 24 could be used by a bridal shop or other formal wear facility, to streamline, customize, and economize the wedding dress design process. A given bridal shop or retailer could purchase kit 24 to assemble a wide variety of dress designs without the time consuming and expensive process of buying multiple sizes of multiple designs from multiple designers with the arrival of each design season.

Kit 24 is currently comprised of four bodice 26 designs, four sleeve 30 designs, three skirt 28 designs, and three train 32 designs. A salesperson can select one style of each part depending on the preferences of bride 22 and each part can be tried on accordingly. If the resulting appearance of the parts does not result in a dress 20 which is to the liking of bride 22, individual parts can be removed and replaced with a part of a different design. For example, if bride 22 selects bodice C, sleeve B, skirt C, and train B, resulting dress 20 will substantially appear as shown in FIG. 1 (although FIG. 1 shows the completed dress without the seam tapes attached). However, if the bride determines that one of the components is not to her liking, sleeve B can be removed and replaced with one of the other sleeves, or bodice C can be similarly replaced with one of the other bodices until the resulting dress 20 has a basic design to the liking of bride 22. To assist in temporarily creating dress 20 on bride 22 each sleeve 30 can be provided with a plurality of tongue fasteners which attach to a plurality of loop fasteners provided on the straps of each bodice.

However, the process of creating dress 20 need not, and likely will not, stop at the selection of a bodice 26, skirt 28, sleeves 30, and train 32. Each dress 20 can then be customized with the addition of accessories as shown in FIGS. 1 and 2. This process can continue until dress 20 not only consists of the proper basic components, but also of the proper accessories in the mind of bride 22.

Along with the selection of the basic part designs, kit 24 allows for the use of one size to fit almost all brides 22. The present invention accomplishes this by providing strips of seam tape 92 having a plurality of snap bottoms 94 and snap tops 96, which allow the sizes of each part to be adjusted to fit a wide spectrum of dimensions. The bridal shop and/or retailer need not therefore invest in a wide range of sizes, but rather can fit substantially all brides through the use of kit 24.

Once the particular bodice 26, skirt 28, sleeve 30, and train 32 design have been selected, the desired accessories have been selected, and the measurements of bride 22 have been taken, the seamstress can commence with the manufacturing of the customized dress. Whereas dresses are normally sized by measuring bride 22 and then selecting a pre-fabricated dress based on only these raw dimensions, dress 20 resulting from kit 24 will much more closely correspond to the actual measurements of bride 22 in that dress 20 has essentially already been tried on. This results not only in less expense and a less time consuming process, but also removes a great deal of aggravation from the process. Once dress 20 is completed, an embroidered name tag can be sewn to an inconspicuous location on the inside of the dress to indicate that the dress was custom made for the particular bride by the particular bridal shop.

From the foregoing it can be appreciated that the present invention brings to the art a new and useful wedding dress design kit and a method for manufacturing a wedding dress. The wedding dress design kit will save bridal shops a great deal of expense in that the financial outlay for various sizes and styles of each designer's line of dresses can be avoided through the purchase of a kit which is comprised of dress components which can be mixed and matched to create a customized dress. Moreover, the bride will be more satisfied with the ultimate dress created in that the process will be less time-consuming, and each dress created will be uniquely tailored and designed to the likings of each bride.

What is claimed is:

1. A wedding dress design kit having component parts capable of being assembled to form a prototypical wedding dress having a particular appearance and size from which an actual wedding dress can then be manufactured based on the appearance and size of the prototypical wedding dress, the wedding dress design kit comprising the combination of:

a plurality of bodices, each bodice having a different shape, means for altering the dimensions of the bodice to fit various size human torsos, openings adapted to allow for passage of human arms therethrough, a waist portion adapted to fit around a human waist, and a back portion;

a plurality of sleeves, each sleeve having a different shape and means for altering the dimensions of the sleeves to fit various size arms, each sleeve adapted to attach to the arm openings of each bodice such that an arm may pass through the arm opening and into the sleeve;

a plurality of skirts, each skirt having a different shape and means for altering the dimensions of the skirts to fit various size waists, each skirt being adapted to be secured around the waist portion of each bodice; and a plurality of trains, each train having a different length, a top edge, and means for affixing the train to the back portion of each bodice.

2. The wedding dress design kit of claim 1, wherein the altering means for the bodices, the altering means for the sleeves, and the altering means for the skirts include a plurality of variable length fasteners attached to predetermined locations on the bodices, sleeves, and skirts.

3. The wedding dress design kit of claim 2, wherein the variable length fasteners include a plurality of snap tops and a plurality of mating snap bottoms disposed at regular intervals on lengths of seam tape attached at the predetermined locations on the bodices, sleeves, and skirts.

4. The wedding dress design kit of claim 1, wherein the means for affixing the train to the bodice includes a plurality of fasteners provided on the top edge of the train which cooperate with fasteners provided on the back portion of the bodice to affix the train to the bodice.

5. The wedding dress design kit of claim 1 further including a plurality of accessories adapted to be pinned to the dress.

6. The wedding dress design kit of claim 1, wherein each sleeve is provided with means for attaching the sleeve to the arm openings of each bodice.

7. The wedding dress design kit of claim 6, wherein the means for attaching sleeves to the bodice arm openings includes a plurality of tongue fasteners provided on one of the sleeve and the bodice, and a plurality of loop fasteners provided on the other of the sleeve and bodice, the tongue fasteners being adapted to engage the loop fasteners to attach the sleeves to the bodices.

8. A method of designing a wedding dress from a kit including a plurality of articles including differently shaped and sized bodices, sleeves, skirts, and trains, each bodice, sleeve and skirt having means for altering the respective sizes thereof, the method comprising the steps of:

selecting a bodice style, sleeve style, skirt style, and train style from the plurality of bodices, sleeves, skirts, and trains;

placing the bodice on the torso of a bride and using the altering means to adjust the size of the bodice to fit the bride;

placing the skirt around the waist of the bride and using the altering means to adjust the size of the skirt to fit the bride;

placing the sleeves on the arms of the bride and using the altering means to adjust the size of the sleeves to fit the bride;

affixing the train to the bodice;

repeatedly removing the bodice, sleeves, skirt, or train, and replacing the removed article with other similar articles having different shapes or designs until a desired, prototypical wedding dress design is attained; and manufacturing a wedding dress based on the styles and sizes of the bodice, sleeves, skirt, and train of the prototypical wedding dress design.

9. The method of claim 8 further comprising the steps of selecting accessories for the dress and temporarily affixing the accessories to the dress to result in various dress designs.

10. The method of claim 9 wherein the temporarily affixing step is performed by pinning the accessories to the dress.

11. The method of claim 8, wherein the using altering means step to adjust the dimensions of the bodices, the sleeves, and the skirts is performed by adjusting the length of mating pairs of seam tape attached to predetermined locations on the bodices, the sleeves, and the skirts, a plurality of snap bottoms and snap tops being disposed at regular intervals along the mating pairs of seam tape, wherein the dimensions of the bodices, sleeves, and skirts are altered by adjusting the particular snap bottom to which each snap top is attached.

12. The method of claim 8 further including the step of temporarily fastening the sleeves to the bodices.

13. The method of claim 8, further including the steps of rendering a sketch of the wedding dress created through the selecting, placing, adjusting, and affixing steps but without depicting the altering means to provide a more accurate indication of the actual appearance of the dress resulting from the method.

* * * * *